US009976578B2

(12) United States Patent
Cazier et al.

(10) Patent No.: US 9,976,578 B2
(45) Date of Patent: May 22, 2018

(54) SYSTEM FOR BLOCKING RELATIVE TRANSLATIONAL MOVEMENT BETWEEN TWO PARTS

(71) Applicant: DOUCE HYDRO, Albert (FR)

(72) Inventors: Olivier Cazier, Albert (FR); Jean-Marc Vandenbulke, Albert (FR)

(73) Assignee: DOUCE HYDRO, Albert (FR)

( * ) Notice: Subject to any disclaimer, the term of this patent is extended or adjusted under 35 U.S.C. 154(b) by 0 days. days.

(21) Appl. No.: 14/787,922

(22) PCT Filed: Apr. 30, 2013

(86) PCT No.: PCT/FR2013/050959
§ 371 (c)(1),
(2) Date: Oct. 29, 2015

(87) PCT Pub. No.: WO2014/177774
PCT Pub. Date: Nov. 6, 2014

(65) Prior Publication Data
US 2016/0076562 A1 Mar. 17, 2016

(51) Int. Cl.
*F15B 15/26* (2006.01)

(52) U.S. Cl.
CPC ..... *F15B 15/26* (2013.01); *F15B 15/262* (2013.01); *F15B 2015/268* (2013.01)

(58) Field of Classification Search
CPC ..... F15B 15/262; F15B 2015/268
USPC ..... 92/17, 26, 27, 28
See application file for complete search history.

(56) References Cited

U.S. PATENT DOCUMENTS 3,452,996 A * 7/1969 Swarbrick ..... B23B 31/207 279/158
3,664,236 A * 5/1972 Malott ..... F15B 15/262 188/67
4,264,229 A * 4/1981 Falk ..... F16D 1/0805 192/85.13
4,619,188 A * 10/1986 Kimura ..... F15B 15/262 92/26

(Continued)

FOREIGN PATENT DOCUMENTS

EP 0 534 879 A1 3/1993
EP 1 898 103 A2 3/2008

(Continued)

OTHER PUBLICATIONS

International Search Report, dated Jan. 14, 2014, from corresponding PCT Application.

*Primary Examiner* — Nathaniel Wiehe
*Assistant Examiner* — Michael Quandt
(74) *Attorney, Agent, or Firm* — Young & Thompson

(57) ABSTRACT

A system 5 for securely blocking relative translational movement between a cylindrical shaft and an element 112, includes a blocking element 50 in which an immobilization element 55 is arranged, the immobilization element being associated with a viscoelastic fluid 8 disposed between the blocking element 50 and the immobilization element 55 in such a way that translational movement is blocked when the viscoelastic fluid 8 is pressurized in the blocking cylinder and translational movement is possible when the viscoelastic fluid 8 is no longer pressurized. An actuating cylinder equipped with such a secure blocking system is also described.

15 Claims, 1 Drawing Sheet

(56) References Cited

U.S. PATENT DOCUMENTS

| | | | | | |
|---|---|---|---|---|---|
| 4,779,513 | A * | 10/1988 | Kimura | ..... | F15B 15/262<br>188/170 |
| 5,051,018 | A * | 9/1991 | Appell | ..... | F16D 1/0805<br>403/5 |
| 2008/0054239 | A1 | 3/2008 | Porel | | |

FOREIGN PATENT DOCUMENTS

| | | | | | |
|---|---|---|---|---|---|
| EP | 2 226 513 | A2 | 9/2010 | | |
| FR | 2 557 219 | A1 | 6/1985 | | |
| GB | 2112677 | A * | 7/1983 | ..... | B23B 31/305 |
| GB | 2111172 | B * | 5/1985 | ..... | F16D 1/0805 |
| WO | WO 2008054294 | A1 * | 5/2008 | ..... | B23B 31/305 |

* cited by examiner

SYSTEM FOR BLOCKING RELATIVE TRANSLATIONAL MOVEMENT BETWEEN TWO PARTS

This invention relates to the field of locking systems, and more particularly to a system for locking the relative movement of two parts relative to each other, one part being mobile, the other part being stationary.

The invention relates particularly to a device for locking a cylindrical shaft relative to a body, one of these two elements being mobile and the other being stationary. More particularly, the invention relates to a position blocking system for such shafts.

BACKGROUND OF THE INVENTION

It is often necessary to have to lock a cylindrical shaft in use position relative to another element. This is particularly the case when using a jack or a press.

Jacks or presses are used when it is necessary to exert a force, for example of pressure, that the user alone cannot exert for sufficient time or that he cannot exert at all.

Hydraulic jacks are thus used in numerous fields, and, for example, the field of conveying for elevators, lifts, rockers, positioning actuators, etc.; the field of public works and of shipyards for the positioning of drilling platforms, maneuvering and blocking of lock gates; the field of transportation for barges, dredges, boxcars and special carriers, bridges, . . . .

In these applications, it is often necessary that the jack be kept in position regardless of its load for rather long periods.

To hold, i.e., to block, the jack in a given position, the jacks are equipped with locking means.

Today, various locking means are used. The most well known is a hydraulic locking means, using a hydraulic fluid such as a hydraulic oil. However, this type of hydraulic means does not make it possible to hold a jack in position under a load for a long period. Actually, it is very difficult to maintain the position due to the change in volume of the oil by compression or expansion as a result of temperature change. Over the longer term, these systems can also have leaks that no longer allow a stable maintaining of position.

To overcome these problems, other types of blocking systems for hydraulic jacks are used.

One of these blocking systems is a locking system with an element of the sleeve type. This system consists of a conical housing in which a ring or sleeve of complementary conical exterior shape is placed. It is in this ring that the piston rod of the jack slides. The ring can be moved axially in relation to the housing to clamp the piston of the jack. Movement is achieved using a piston placed in the narrow part of the housing. This piston moves under the pressure of a hydraulic fluid or any other suitable fluid. When it is under pressure, the piston moves the ring in a direction opposite to that of the load of the piston of the jack, and makes it possible for the piston rod of the jack to slide. When it is no longer under pressure, the piston moves the ring in the same direction as the load of the piston of the jack, which by constricting around the piston of the jack prevents the latter from sliding. This system is, for example, illustrated in the patent EP2226513.

A drawback of this type of system comes from the fact that the blocking can take place only in a single sliding direction of the piston of the jack. It is therefore necessary that the hydraulic jack be used vertically.

Another blocking system used and described in the patent EP0534879 relates to a double-action jack. This system is characterized by the fact that the piston rod is mounted tight in a cylinder, said piston rod being immobilized in the cylinder because of a lack of pressure from a fluid and freed in movements relative to this cylinder by an expansion provided by the pressure of a fluid between the piston and the cylinder.

A drawback of this system comes from the fact that the tight mounting of the piston in the cylinder makes it a difficult system to assemble.

Another significant drawback of these systems is that in case of failure in the area of the hydraulic fluid, the system is held in blocked position, which poses problems in terms of safety.

SUMMARY OF THE INVENTION

This invention therefore has as its object to remedy one or more of the drawbacks of the prior art by proposing a secure blocking system for a cylindrical shaft moving in relation to an element, such as, for example, a jack, making possible a better blocking and a quick and easy unblocking in case of failure of the hydraulic fluid system that is used for the unblocking.

To do this, this invention proposes a secure blocking system for two parts in translational movement relative to each other, one of the two parts being inserted into the other, the other comprising a blocking means in which an immobilizing element is placed, the immobilizing element being associated with a viscoelastic fluid situated between the blocking means and the immobilizing element in such a way that the movement in translation is blocked when the viscoelastic fluid is under pressure in the blocking means and the movement in translation is possible when the viscoelastic fluid is no longer under pressure.

According to one embodiment of the invention, the secure blocking system is a system for blocking a cylindrical shaft and an element, moving in translation relative to one another.

According to one embodiment of the invention, the immobilizing element is configured to act axially on the cylindrical shaft.

According to one embodiment of the invention, the blocking cylinder has an axial bore, suitable for the sliding of the cylindrical shaft and having zones of different diameters, the diameter of the central part of the bore being configured so as to house a fluidtight annular chamber between the outer surface of the cylindrical shaft and the inner surface of the bore in which the viscoelastic fluid is situated.

According to one embodiment of the invention, the system comprises a viscoelastic fluid intake that appears in the form of a blind hole that is oriented perpendicular to the axis of translation of the cylindrical shaft and that is formed in the blocking cylinder, this intake comprising means for keeping the viscoelastic fluid under pressure in the blocking cylinder to keep the viscoelastic fluid 8 at a minimum pressure.

According to one embodiment of the invention, the immobilizing means are formed by a tube placed in the annular chamber so as to be in contact with the cylindrical shaft when it is present, the viscoelastic fluid being located between the tube and the inner surface of the bore.

According to one embodiment of the invention, the system comprises a hydraulic fluid intake configured to bring a hydraulic fluid to the intersection of the surface of the cylindrical shaft when it is present and an inner surface of the immobilizing means, in such a way that in the presence of hydraulic fluid, the cylindrical shaft is free in translation.

The invention also relates to a hydraulic or pneumatic jack, single- or double-action, having a secure blocking system according to the invention.

According to one embodiment of the invention, the secure blocking system is attached upstream from a cylinder of the jack, relative to the load or the element on which the pressure or the lifting is exerted.

According to one embodiment of the invention, the secure blocking system is attached downstream from a cylinder of the jack, relative to the load or the element on which the pressure or the lifting is exerted.

BRIEF DESCRIPTION OF THE DRAWINGS

Other characteristics and advantages of the invention will be better understood and will come out more clearly on reading the description made, hereafter, by referring to the accompanying figures given by way of example.

DETAILED DESCRIPTION OF THE PREFERRED EMBODIMENTS

The invention relates to a secure locking or blocking system 5 of one part relative to another part, with the two parts moving relative to one another. The secure blocking system of the two parts moving in translation relative to one another comprises a blocking means in which an immobilizing element is placed, the immobilizing element being associated with a viscoelastic fluid situated between the blocking means and the immobilizing element in such a way that the movement in translation is blocked when the viscoelastic fluid is under pressure in the blocking means and such that the movement in translation is possible when the viscoelastic fluid is no longer under pressure. One of the two parts is inserted into the other.

Figure 1:
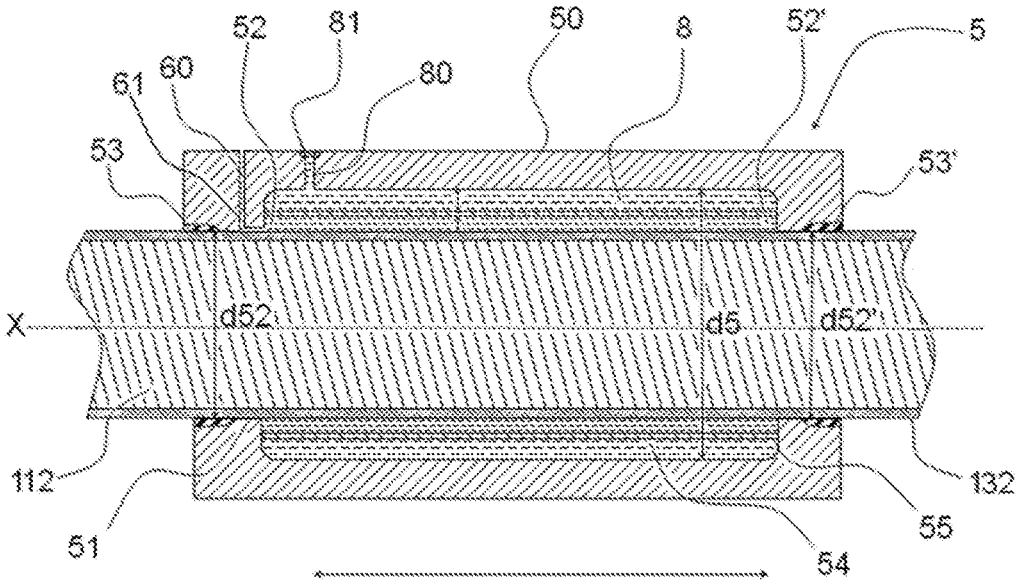
FIG. 1 is an axial cutaway view of the secure blocking system according to the invention.

This blocking system, illustrated in FIG. 1, is used, for example, for mobile cylindrical shafts 112 in movement relative to a stationary element or conversely for stationary cylindrical shafts 112 relative to a mobile element in movement.

By cylindrical shaft is meant a hollow or solid cylindrical longitudinal body. This cylinder is mounted to slide in an element. The element is, for example, of the cylindrical or non-cylindrical sleeve type.

By mounted to slide is meant the fact that the cylindrical shaft 112 slides in the element, as is the case in, for example, a jack, or conversely that the element slides around the shaft 112, as is the case for the slide of a press. Thus, in the following description, it is one or the other of the two elements that slides relative to the other.

The blocking system according to the invention makes it possible to block the translation of the cylindrical shaft 112 relative to the element.

The secure blocking system according to the invention thus comprises a blocking means.

According to one embodiment of the invention, this blocking means is a blocking cylinder 50. This blocking cylinder 50 has an axial bore 51, in which the cylindrical shaft 112 slides, having zones of different diameters.

The diameter of the central part of the bore 51 is configured so as to house an annular chamber 54 between the outer surface of the cylindrical shaft 112 and the inner surface of the bore 51. The ends of the annular chamber 54 are formed by the reduction in diameter of the bore 51 of the cylinder 50. The fluidtightness in the annular chamber 54 is maintained by means of seals 53, 53' that are placed at the ends of the blocking cylinder 50. Therefore, in order, there are: a seal 53, an end 52 of the blocking cylinder, the annular chamber 54, a second end 52' of the blocking cylinder, and a second seal 53'.

According to one embodiment of the invention, not shown, the cylinder is formed of two parts. A first part has an end, with a seal, whose bore diameter is complementary to the outer diameter of the piston rod and an elongated part whose bore diameter is configured so as to house an annular chamber between the outer surface of the piston rod and the inner surface of the bore. The second part forms the other end of the cylinder. The inner diameter of the bore of this second part is complementary to the outer diameter of the piston rod and has a seal.

Inside the annular chamber 54 and in contact with the outer surface of the cylindrical shaft 112 is placed an element for immobilizing the shaft relative to the cylinder or vice versa. This immobilizing element is of the type of a tube 55. This immobilizing element acts axially on the shaft 112 to immobilize the shaft 112 relative to the cylinder 50. The thickness of the tube 55 is less than the radius of the annular chamber 54, which makes it possible to leave a space between the tube 55 and the inner surface of the bore 51 in the annular chamber 54.

The tube 55 is made of a material that is sufficiently flexible to be deformed by the pressure of a fluid, but sufficiently strong to withstand the pulling force when the piston rod is in translation. According to one embodiment of the invention, the tube 55 is made of steel. The final thickness of the tube 55 is defined as a function of the radius of the annular chamber 54, of the diameter of the rod, and of the length of the blocking cylinder 50, to ensure that the tube 55 retains its characteristics of flexibility and strength. The inner diameter of the tube 55 is defined so as to be in direct contact over its entire length with the outer surface of the piston rod. The tube is configured to be in abutment at each of its ends against the ends of the blocking cylinder, particularly during a translational force when the piston rod slides in the tube.

One of the ends 52 of the blocking cylinder 50 has an intake 60 for fluid, for example hydraulic fluid. According to one embodiment of the invention, the fluid is hydraulic oil. This fluid intake 60 is positioned perpendicular to the axis X of translation of the shaft 112, and therefore also perpendicular relative to the axis of the blocking cylinder 50. The fluid intake 60 appears in the form of a blind hole that comes out into a channel 61 that is formed at the intersection of the outer surface of the piston rod and the inner surface of the cylinder. This channel itself comes out between the tube 55 and the outer surface of the shaft 112.

The free space of the annular chamber of the blocking system is totally filled with a viscoelastic fluid 8 that is kept at a minimum pressure. The filling is performed via a pipe 80 for intake of the fluid.

The closing of the intake pipe 80 of viscoelastic fluid 8 is performed with means for keeping the viscoelastic fluid 8 under pressure. These pressure holding means are of the plug or valve type or any other type of well-known closing means (e.g., in the embodiment shown in the figures, a valve 81 as shown in the accompanying figures). The pressure holding means are selected so as to make possible, during the normal operation of the blocking system, the entry of the fluid and to prevent its discharge while keeping the viscoelastic fluid under pressure, and during an emergency operation, to make possible the evacuation of the viscoelastic fluid.

Figure 2:
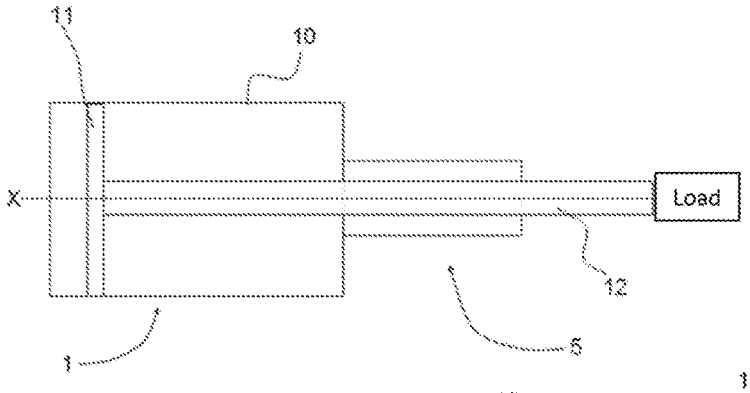
FIG. 2 is an axial cutaway view of a jack according to an embodiment of the invention.

According to one embodiment of the invention, the secure blocking system, illustrated in FIG. 1, is a secure blocking system for hydraulic or pneumatic jacks, as well as a hydraulic jack equipped with this blocking system illustrated in FIG. 2. In this embodiment of the invention, the cylindrical shaft 112 of FIG. 1 is a jack piston rod 12 illustrated in FIG. 2.

The jack 1 covered by this invention comprises a cylinder 10 and a piston 11 associated with a piston rod 12 illustrated in FIGS. 1 and 2. The piston 11 and the piston rod 12 are mounted to slide in the cylinder 10. The translation of the piston rod 12 thus makes possible the movement by pressure or lifting of objects or an element as described previously. The jack 1 is single- or double-action, i.e., a work fluid, for example a liquid of the hydraulic type, or compressed gas, such as air, acts either in one direction of translation or in both directions of translation. It is on this translation that the secure blocking system 5 according to the invention acts so as to keep the piston rod 12 in a determined position.

According to an embodiment of the invention, the piston rod 12 is coated with a ceramic base 132, which makes it possible to have a high coefficient of friction.

The secure blocking system 5 according to the invention, and which is used for a jack according to the invention, comprises a blocking cylinder 50. This blocking cylinder 50 has an axial bore 51, in which the piston rod 12, referenced 112 in FIG. 1, slides, having zones of different diameters. More specifically, in the area of the two ends 52, 52' of the blocking cylinder 50, the diameter d52, d52' of the bore is complementary to the outer diameter of the piston rod. According to one embodiment of the invention, the diameter d52, d52' of the bore of the two ends 52, 52' is equivalent to that of the outer diameter of the piston rod, in such a way that the inner surface of the bore is in direct contact with the outer surface of the piston rod. Each of the ends 52, 52' of the cylinder 50 also has seals 53, 53'.

The diameter d5 of the central portion of the bore 51 is configured so as to house an annular chamber 54 between the outer surface of the piston rod and the inner surface of the bore 51. The ends of the annular chamber are formed by the reduction in diameter of the bore of the cylinder. The fluidtightness in the annular chamber 54 is maintained using seals 53, 53' placed at the ends of the blocking cylinder 50. The elements in contact with the piston rod are therefore in order: a seal 53, an end 52 of the blocking cylinder, the annular chamber 54, a second end 52' of the blocking cylinder, and a second seal 53'.

According to one embodiment of the invention, the seal is placed in a cavity made at the end of the blocking cylinder between the cylinder and the outer surface of the piston rod.

According to one embodiment of the invention, not shown, the cylinder is formed of two parts. A first part has an end, with a seal, whose bore diameter is complementary to the outer diameter of the piston rod and an elongated part whose diameter of the bore is configured so as to house an annular chamber between the outer surface of the piston rod and the inner surface of the bore. The second part forms the other end of the cylinder. The inner diameter of the bore of this second part is complementary to the outer diameter of the piston rod and has a seal.

Inside the annular chamber 54 and in contact with the surface of the piston rod is placed an element for immobilizing the piston rod. This immobilizing element is of the type of a tube 55. This immobilizing element acts axially on the piston rod to immobilize it. The thickness of the tube is less than the radius of the annular chamber 54, which makes it possible to leave a space 56 between the tube 55 and the inner surface of the bore 51 in the annular chamber 54.

The tube 55 is made of a material that is sufficiently flexible to be deformed by the pressure of a fluid, but sufficiently strong to withstand the pulling force when the piston rod is in translation. According to one embodiment of the invention, the tube 55 is made of steel. The final thickness of the tube 55 is defined as a function of the radius of the annular chamber 54, of the diameter of the rod, and of the length of the blocking cylinder 50, to ensure that the tube 55 retains its characteristics of flexibility and strength. The inner diameter of the tube 55 is defined so as to be in direct contact over its entire length with the outer surface of the piston rod. The tube is configured to be in abutment at each of its ends against the ends of the blocking cylinder, particularly during a translational force when the piston rod slides in the tube.

One of the ends 52 of the blocking cylinder 50 has an intake 60 for fluid, for example hydraulic fluid. According to one embodiment of the invention, the fluid is hydraulic oil. This fluid intake 60 is positioned perpendicular to the axis X of translation of the piston rod, and therefore also perpendicular relative to the axis of the blocking cylinder 50. The fluid intake 60 appears in the form of a blind hole that comes out into a channel 61 that is formed at the intersection of the outer surface of the piston rod and the inner surface of the cylinder. This channel itself comes out between the tube 55 and the outer surface of the piston rod.

The free space of the annular chamber 54 of the blocking system, i.e., the space between the tube and the inner surface of the bore of the blocking cylinder, is totally filled with a viscoelastic fluid 8.

According to one embodiment of the invention, the viscoelastic fluid has a silicone base.

This viscoelastic fluid 8 is more compressible than hydraulic oil and is deformable under the action of considerable pressure.

The filling of the space with viscoelastic fluid 8 is done by means of a viscoelastic fluid intake 80 formed in the blocking cylinder. This intake 80 appears in the form of a blind hole oriented perpendicular to the axis X of translation of the piston rod. This intake 80 is kept closed after the filling of the space with the viscoelastic fluid to keep the viscoelastic fluid at a minimum pressure.

The closing of the intake pipe 80 of viscoelastic fluid 8 is performed with means for keeping the viscoelastic fluid 8 under pressure. These pressure holding means are of the plug or valve type or any other type of well-known closing means (e.g., in the embodiment shown in the figures, a valve 81 as shown in the accompanying figures). The pressure holding means are selected so as to make possible, during the normal operation of the blocking system, the entry of the fluid and to prevent its discharge while keeping the viscoelastic fluid under pressure, and during an emergency operation, to make possible the evacuation of the viscoelastic fluid.

The secure blocking system 5 according to the invention has means for fastening to the cylinder of the jack.

According to one embodiment of the invention, the secure blocking system is attached upstream from the cylinder of the jack relative to the load or the element on which the pressure or the lifting is exerted (FIG. 2).

Figure 3:
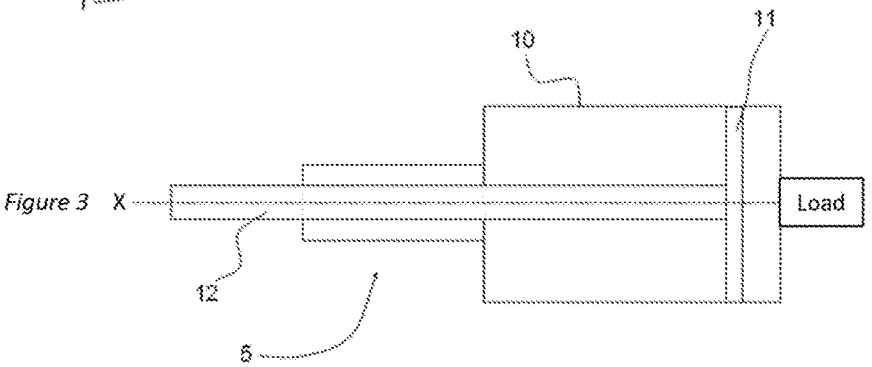
FIG. 3 is an axial curaway view of a jack according to another embodiment of the invention.

According to one embodiment of the invention, the secure blocking system is attached downstream from the cylinder of the jack relative to the load or the element on which the pressure or the lifting is exerted (FIG. 3).

The blocking system 5 according to the invention and the jack 1 having such a blocking system 5 operates in the following way:

When the jack 1 is used, the piston rod slides in the tube 55 of the blocking system 5 according to the invention. To block the jack in a determined position, the viscoelastic fluid 8 is kept under pressure. Under these conditions, the viscoelastic fluid 8 exerts a pressure on the walls of the tube 55 that thus will be deformed in the direction of the piston rod. The deformation of the tube 55 will increase the friction between the piston rod and the tube 55 and brake the piston rod. The pressure exerted on the tube 55 is defined so as to allow the complete stopping of the translation of the piston rod. The pressure by the viscoelastic fluid 8 on the tube is maintained for the time necessary for the lifting or pressure operation or other operation performed by the jack 1.

The use of such a viscoelastic fluid makes it possible to maintain the blocking for the desired time, without any problems of leaking or of compression/expansion due to variations of temperatures.

The unblocking in translation of the piston rod is performed by an intake of hydraulic fluid via the hydraulic fluid intake pipe, between the tube 55 and the outer surface of the piston rod. This hydraulic fluid intake exerts enough pressure to deform the tube 55 in the direction of the blocking cylinder 50. In this configuration, the piston rod is free to slide.

The deformation of the tube 55 by the hydraulic fluid is made possible by the compression properties of the viscoelastic fluid.

In case of failure of the intake of the hydraulic fluid, the system 5 according to the invention allows an emergency unblocking of the piston rod. This emergency unblocking is done by opening the pressure holding means, or valve 81, of the viscoelastic fluid intake 80.

The presence of the viscoelastic fluid makes it possible to avoid problems due to the failure of the intake of the hydraulic fluid. Actually, if for any reasons whatsoever, the intake of hydraulic fluid is no longer possible, the system is stuck in blocking mode. The presence of the viscoelastic fluid makes it possible to unblock the system simply by opening the pressure holding means. Actually, the opening of the pressure holding means of the viscoelastic fluid intake pipe eliminates the pressure exerted on the viscoelastic fluid that no longer exerts pressure on the tube. The braking of the piston rod by the tube by friction is thus stopped, and the piston rod can then slide freely.

It should be obvious for a person skilled in the art that this invention must not be limited to the details given above and makes possible embodiments under numerous other specific forms without getting away from the field of application of the invention. Consequently, these embodiments must be considered by way of illustration and can be modified without, however, going outside the scope defined by the claims.

The invention claimed is:

1. A blocking system for secure blocking of two parts moving in translation relative to one another, comprising:

a first part, including a blocking cylinder (50); and a second part insertable into the blocking cylinder (50) of the first part, the blocking cylinder (50) comprising a tube (55) located inside the blocking cylinder, and a viscoelastic fluid (8) provided between the blocking cylinder and the tube (55), wherein said tube (55) is deformable so as to deform towards said second part responsive to a pressure from said viscoelastic fluid (8), and to apply a friction to block a movement in translation of said second part relative to said first part, wherein said second part is mobile in translation relative to said first part during an emergency operation in which said pressure on said tube from said viscoelastic fluid is absent, wherein the second part comprises a cylindrical shaft, and wherein the blocking cylinder (50) further comprises a hydraulic fluid intake (60) configured to bring a hydraulic fluid between an outer surface of the cylindrical shaft and an inner surface of the tube (55), wherein said viscoelastic fluid is more compressible than said hydraulic fluid, wherein said tube (55) is also deformable so as to deform away from said outer surface of the cylindrical shaft responsive to a pressure from said hydraulic fluid between said outer surface of the cylindrical shaft and said inner surface of the tube (55), thereby compressing the viscoelastic fluid, and wherein the cylindrical shaft is free in translation when the immobilizing element is deformed away from said outer surface of the cylindrical shaft under influence of a pressure of said hydraulic fluid.

2. The blocking system according to claim 1, wherein the tube (55) is configured to act axially on the cylindrical shaft.

3. The blocking system according to claim 2, wherein the blocking cylinder (50) has an axial bore (51), configured to permit the cylindrical shaft to slide therethrough, a fluidtight annular chamber (54) being located between the outer surface of the cylindrical shaft and an inner surface of the axial bore (51), the viscoelastic fluid (8) being located in said annular chamber.

4. The blocking system according to claim 3, wherein the tube (55) is placed in the annular chamber (54) so as to be in contact with the cylindrical shaft, the viscoelastic fluid (8) being located between the tube (55) and the inner surface of the axial bore (51).

5. The blocking system according to claim 2, further comprising:

a viscoelastic fluid intake (80) comprising a hole and a pressure holding element, which comprises either of a valve or a plug, wherein the hole is formed in the blocking cylinder and is oriented perpendicular to an axis (X) of translation of the cylindrical shaft, wherein said pressure holding element closes the hole during a normal operation to keep the viscoelastic fluid (8) under a minimum pressure in the blocking cylinder (50), and, during the emergency operation, said pressure holding element opens the hole to discharge the viscoelastic fluid from the blocking cylinder.

6. The blocking system according to claim 5, wherein the blocking cylinder has an axial bore configured for the cylindrical shaft to slide therethrough, wherein a fluidtight annular chamber is located between the outer surface of the cylindrical shaft and an inner surface of the axial bore, and wherein the viscoelastic fluid is provided in said annular chamber.

7. The blocking system according to claim 6, wherein the tube (55) is placed in the annular chamber (54) so as to be in contact with the cylindrical shaft, the viscoelastic fluid (8) being located between the tube (55) and the inner surface of the axial bore (51).

8. The blocking system according to claim 1, wherein the blocking cylinder (50) has an axial bore (51), configured to permit the cylindrical shaft to slide therethrough, a fluidtight annular chamber (54) being located between the outer surface of the cylindrical shaft and an inner surface of the axial bore (51), the viscoelastic fluid (8) being located in said annular chamber.

9. The blocking system according to claim 8, further comprising:

a viscoelastic fluid intake (80) comprising a blind hole and a pressure holding element, which comprises either of a valve or a plug, wherein the hole is formed in the blocking cylinder and is oriented perpendicular to an axis (X) of translation of the cylindrical shaft, wherein said pressure holding element closes the hole during a normal operation to keep the viscoelastic fluid (8) under a minimum pressure in the blocking cylinder (50), and, during the emergency operation, said pressure holding element opens the hole to discharge the viscoelastic fluid from the blocking cylinder.

10. The blocking system according to claim 9, wherein the tube (55) is placed in the annular chamber (54) so as to be in contact with the cylindrical shaft, the viscoelastic fluid (8) being located between the tube (55) and the inner surface of the axial bore (51).

11. The blocking system according to claim 8, wherein the tube (55) is placed in the annular chamber (54) so as to be in contact with the cylindrical shaft, the viscoelastic fluid (8) being located between the tube (55) and the inner surface of the axial bore (51).

12. The blocking system according to claim 1, further comprising:

a viscoelastic fluid intake (80) comprising a hole and a pressure holding element, which comprises either of a valve or a plug, wherein the hole is formed in the blocking cylinder and is oriented perpendicular to an axis (X) of translation of the cylindrical shaft, wherein said pressure holding element closes the hole during a normal operation to keep the viscoelastic fluid (8) under a minimum pressure in the blocking cylinder (50), and, during the emergency operation, said pressure holding element opens the hole to discharge the viscoelastic fluid from the blocking cylinder.

13. A hydraulic or pneumatic jack, comprising the blocking system (5) according to claim 1.

14. The jack according to claim 13, wherein the blocking system (5) is attached upstream from a cylinder of the jack, relative to a load or an element pressed or lifted by the jack.

15. The jack according to claim 13, wherein the secure blocking system (5) is attached downstream from the cylinder of the jack relative to the load or the element pressed or lifted by the jack.

* * * * *